US007597669B2

(12) United States Patent
Huang

(10) Patent No.: US 7,597,669 B2
(45) Date of Patent: Oct. 6, 2009

(54) BODY MASSAGE APPARATUS

(75) Inventor: Chien Ming Huang, Taipei (TW)

(73) Assignee: FKA Distributing Co., Commerce Township, MI (US)

( * ) Notice: Subject to any disclaimer, the term of this patent is extended or adjusted under 35 U.S.C. 154(b) by 653 days.

(21) Appl. No.: 11/365,238

(22) Filed: Mar. 1, 2006

(65) Prior Publication Data

US 2007/0208284 A1 Sep. 6, 2007

(51) Int. Cl.
*A61H 7/00* (2006.01)

(52) U.S. Cl. ..... 601/86; 601/98; 601/101; 601/103

(58) Field of Classification Search ..... 601/85, 601/86, 87, 90, 93, 94, 98, 99, 100–103
See application file for complete search history.

(56) References Cited

U.S. PATENT DOCUMENTS

| | | | |
|---|---|---|---|
| 3,001,523 | A | 9/1961 | Sugimoto |
| 3,374,784 | A | 3/1968 | Brent et al. |
| 3,633,571 | A | 1/1972 | Shinagawa |
| 4,167,182 | A | 9/1979 | Yamamura et al. |
| 4,373,516 | A | 2/1983 | Masuda et al. |
| 4,412,534 | A | 11/1983 | Hamabe et al. |
| 4,422,448 | A | 12/1983 | Sugai et al. |
| 4,422,449 | A | 12/1983 | Hamabe |
| 4,491,127 | A | 1/1985 | Yamamura et al. |
| 4,505,267 | A | 3/1985 | Inada |
| 4,574,786 | A | 3/1986 | Hashimoto et al. |
| 4,576,149 | A | 3/1986 | Otuka et al. |
| 4,686,967 | A | 8/1987 | Hashimoto et al. |
| 4,718,408 | A | 1/1988 | Barreiro |
| 4,777,940 | A | 10/1988 | Yamasaki |
| 4,785,798 | A | 11/1988 | Yamasaki |
| 5,020,518 | A | 6/1991 | Spears et al. |

(Continued)

FOREIGN PATENT DOCUMENTS

CN 2587403 Y 11/2003

(Continued)

OTHER PUBLICATIONS

Preliminary Report on Patentability for corresponding International Application No. PCT/US2007/062863, mailed Sep. 12, 2008, 8 pages.

(Continued)

*Primary Examiner*—Steven O Douglas
(74) *Attorney, Agent, or Firm*—Brooks Kushman P.C.

(57) ABSTRACT

A body massager is disclosed with a housing having a longitudinal axis and an external contact surface for receiving a portion of a body of a user. A longitudinal guide is mounted in the housing with a carriage cooperating with the guide for translation therealong. A motor is oriented in the housing, operably coupled to the housing and the carriage such that continuous rotation of the motor in one rotary direction translates the carriage along the guide in at least two directions. A massage formation is supported by the carriage for imparting a massage effect upon the portion of the user's body as the carriage is translated relative to the housing. In another embodiment, a massage bracket is driven about a first axis of rotation; and a massage node mounted to the bracket is driven to rotate relative to the bracket.

22 Claims, 4 Drawing Sheets

U.S. PATENT DOCUMENTS

| | | | | |
|---|---|---|---|---|
| 5,063,911 | A | 11/1991 | Teranishi | |
| 5,179,940 | A | 1/1993 | Barreiro | |
| 5,183,034 | A | 2/1993 | Yamasaki et al. | |
| 5,233,973 | A | 8/1993 | Gill et al. | |
| 5,265,590 | A | 11/1993 | Takagi | |
| 5,305,738 | A | 4/1994 | Shimizu | |
| 5,356,369 | A | 10/1994 | Yamasaki et al. | |
| 5,460,598 | A | 10/1995 | Yamasaki et al. | |
| 5,462,516 | A | 10/1995 | Anderson | |
| 5,464,382 | A | 11/1995 | Wang | |
| 5,630,790 | A | 5/1997 | Ito | |
| 5,685,827 | A | 11/1997 | Shimizu | |
| 5,755,677 | A | 5/1998 | Masuda et al. | |
| 5,785,668 | A | 7/1998 | Shimizu | |
| 5,792,080 | A | 8/1998 | Ookawa et al. | |
| 5,807,288 | A | 9/1998 | Wu | |
| 6,056,708 | A | 5/2000 | Sayama et al. | |
| 6,083,180 | A | 7/2000 | Shimizu | |
| 6,200,282 | B1 | 3/2001 | Furuie et al. | |
| 6,213,962 | B1 | 4/2001 | Shimizu | |
| 6,224,563 | B1 | 5/2001 | Nonoue et al. | |
| 6,283,928 | B1 | 9/2001 | Wang | |
| 6,312,400 | B1 | 11/2001 | Itikawa et al. | |
| 6,402,709 | B1 | 6/2002 | Wu | |
| 6,503,212 | B2 | 1/2003 | Park | |
| 6,511,448 | B1 | 1/2003 | Furuie et al. | |
| 6,517,500 | B2 | 2/2003 | Ichikawa | |
| 6,629,939 | B2 | 10/2003 | Jikiba et al. | |
| 6,656,140 | B2 | 12/2003 | Oguma et al. | |
| 6,749,577 | B2 | 6/2004 | Kume et al. | |
| 6,790,190 | B2 | 9/2004 | Marcantoni | |
| 6,805,680 | B2 | 10/2004 | Klingler | |
| 6,808,500 | B1 | 10/2004 | Cheng-Yi et al. | |
| 6,814,710 | B1 | 11/2004 | Dehli | |
| 6,832,991 | B1 | 12/2004 | Inada et al. | |
| 6,837,861 | B2 | 1/2005 | Lin | |
| 6,840,914 | B1 | 1/2005 | Takamura | |
| 6,849,054 | B1 | 2/2005 | Kim | |
| 6,866,644 | B1 | 3/2005 | Kost | |
| 6,890,313 | B2 | 5/2005 | Kim | |
| 6,899,688 | B2 | 5/2005 | Wu | |
| 6,911,012 | B2 | 6/2005 | Kahn | |
| 6,916,300 | B2 | 7/2005 | Hester et al. | |
| 7,128,721 | B2 * | 10/2006 | Ferber et al. | 601/86 |
| 2002/0138023 | A1 | 9/2002 | Kume et al. | |
| 2003/0009117 | A1 | 1/2003 | Zou | |
| 2003/0018284 | A1 | 1/2003 | Lim | |
| 2003/0032903 | A1 | 2/2003 | Kasai | |
| 2003/0060741 | A1 | 3/2003 | Park | |
| 2003/0120187 | A1 | 6/2003 | Kan et al. | |
| 2003/0199796 | A1 | 10/2003 | Yamazaki et al. | |
| 2003/0212353 | A1 | 11/2003 | Kahn | |
| 2003/0212354 | A1 | 11/2003 | Kahn | |
| 2003/0216673 | A1 | 11/2003 | Miki et al. | |
| 2003/0216674 | A1 | 11/2003 | Miki et al. | |
| 2003/0225351 | A1 | 12/2003 | Wu | |
| 2004/0049136 | A1 | 3/2004 | Lin | |
| 2004/0082889 | A1 | 4/2004 | Wu | |
| 2004/0097851 | A1 | 5/2004 | Inada et al. | |
| 2004/0106882 | A1 | 6/2004 | Tseng | |
| 2004/0122343 | A1 | 6/2004 | Mori et al. | |
| 2004/0127823 | A1 | 7/2004 | Mori et al. | |
| 2004/0158176 | A1 | 8/2004 | Park | |
| 2004/0158180 | A1 | 8/2004 | Liang | |
| 2004/0171972 | A1 | 9/2004 | Shimizu et al. | |
| 2004/0183345 | A1 | 9/2004 | Furuie et al. | |
| 2004/0186398 | A1 | 9/2004 | Furuie | |
| 2004/0210174 | A1 | 10/2004 | Kim | |
| 2004/0211015 | A1 | 10/2004 | Chen | |
| 2004/0225240 | A1 | 11/2004 | Kim | |
| 2004/0230145 | A1 | 11/2004 | Kim | |
| 2004/0236256 | A1 | 11/2004 | Kim | |
| 2004/0243030 | A1 | 12/2004 | Tanizawa et al. | |
| 2004/0243033 | A1 | 12/2004 | Kim | |
| 2004/0243034 | A1 | 12/2004 | Kim | |
| 2004/0249321 | A1 | 12/2004 | Grueger et al. | |
| 2004/0260215 | A1 | 12/2004 | Kim | |
| 2005/0010142 | A1 | 1/2005 | Kim | |
| 2005/0010143 | A1 | 1/2005 | Kim | |
| 2005/0010144 | A1 | 1/2005 | Chen | |
| 2005/0015029 | A1 | 1/2005 | Kim | |
| 2005/0033204 | A1 | 2/2005 | Nakamura et al. | |
| 2005/0049530 | A1 | 3/2005 | Kim | |
| 2005/0049531 | A1 | 3/2005 | Kim | |
| 2005/0080365 | A1 | 4/2005 | Wu et al. | |
| 2005/0090770 | A1 | 4/2005 | Chen | |
| 2005/0090771 | A1 | 4/2005 | Miki | |
| 2005/0096571 | A1 | 5/2005 | Miki | |
| 2005/0101890 | A1 | 5/2005 | Mizoguchi et al. | |
| 2005/0124921 | A1 | 6/2005 | Tseng | |
| 2005/0137503 | A1 | 6/2005 | Hori et al. | |
| 2005/0148912 | A1 | 7/2005 | Liao | |
| 2005/0245851 | A1 | 11/2005 | Ferber et al. | |
| 2005/0256434 | A1 | 11/2005 | Luo | |

FOREIGN PATENT DOCUMENTS

| | | | |
|---|---|---|---|
| EP | 1400230 | A1 | 3/2004 |
| GB | 2123298 | A | 2/1984 |
| GB | 2267440 | A | 12/1993 |
| JP | S5086889 | | 7/1975 |
| JP | S56119251 | A | 9/1981 |
| JP | S5928963 | A | 2/1984 |
| JP | S60135122 | U | 9/1985 |
| JP | H06209974 | A | 8/1994 |
| JP | H07080035 | A | 3/1995 |
| JP | H10216187 | A | 8/1998 |
| JP | 2000262575 | A | 9/2000 |
| JP | 2001017494 | A | 1/2001 |
| JP | 2001029419 | A | 2/2001 |
| JP | 2001314470 | A | 11/2001 |
| JP | 2001314471 | A | 11/2001 |
| JP | 2002063155 | A | 9/2002 |
| JP | 2003038591 | A | 2/2003 |
| WO | 02069880 | A1 | 9/2002 |

OTHER PUBLICATIONS

HoMedics, Shiatsu Massaging Cushion, Moving Massage Mechanism, SBM-200, Instruction Manual and Warranty Information, 2003-2005 HoMedics, Inc., 15 pgs.

Dr. Scholl's, Look. Feel. Do. Better., 2003, Helen of Troy.

Sclater and Chironis, "Mechanisms & Mechanical Devices Sourcebook", Third Edition, 2001, McGraw-Hill, 3 pages.

* cited by examiner

BODY MASSAGE APPARATUS

BACKGROUND OF THE INVENTION

1. Field of the Invention

The present invention relates to massagers.

2. Background Art

The prior art includes body massagers provided within chairs, as well as in portable cushions. These prior art body massagers commonly include a track or guide for moving a massage assembly longitudinally within the chair or cushion. The prior art body massagers are relatively complex and utilize multiple motors, multiple switches, or complicated controls architecture for providing an output massage effect. Due to the complexities, and the associated costs, of conventional body massagers, a consumer's ability to procure such massagers may be limited due to value and affordability.

SUMMARY OF THE INVENTION

An embodiment of the present invention provides a body massager with a housing having a longitudinal axis and an external contact surface for receiving a portion of a body of a user. A longitudinal guide is mounted in the housing and a carriage is oriented within the housing cooperating with the guide for longitudinal translation in the housing along the guide. A motor is oriented in the housing, operably coupled to the housing and the carriage such that continuous rotation of the motor in one rotary direction translates the carriage along the guide in opposed directions. A massage formation is supported by the carriage for imparting the massage effect upon the portion of the user's body as the carriage is translated relative to the housing.

Another embodiment of the present invention provides a body massager with a housing having an external contact surface for receiving a portion of a body of a user. A motor is oriented in the housing, and has an output shaft driven by the motor. A massage bracket is rotationally mounted to the housing and operably engaged to the motor output shaft for rotation about a first axis as the motor output shaft is driven. A massage node is rotationally mounted to the massage bracket about a second axis of rotation that is offset from the first axis of rotation for revolving about the first axis of rotation as the massage bracket is driven by the motor. The massage node is operably engaged to the motor output shaft for rotation relative to the massage bracket about the second axis of rotation as the massage node is driven.

Yet another embodiment of the present invention provides a body massager with a housing having a longitudinal axis and an external contact surface for receiving a portion of a body of a user. A longitudinal guide is mounted in the housing, and a carriage is oriented in the housing, cooperating with the guide for longitudinal translation in the housing along the guide. A motor is mounted to the carriage with a rotary output shaft that is operably coupled to the housing to translate the carriage along the guide. A first kneading massage mechanism is mounted to the carriage and operably coupled to the motor output shaft for imparting a first kneading massage effect to the user. A second kneading massage mechanism is also mounted to the carriage, spaced apart from the first kneading massage mechanism. The second kneading massage mechanism is operably coupled to the motor output shaft for imparting a second kneading massage effect to the user.

The above embodiments, and other embodiments, aspects, objects, features, benefits, and advantages of the present invention are readily apparent from the following detailed description of embodiments of the invention when taken in connection with the accompanying drawings.

DETAILED DESCRIPTION EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
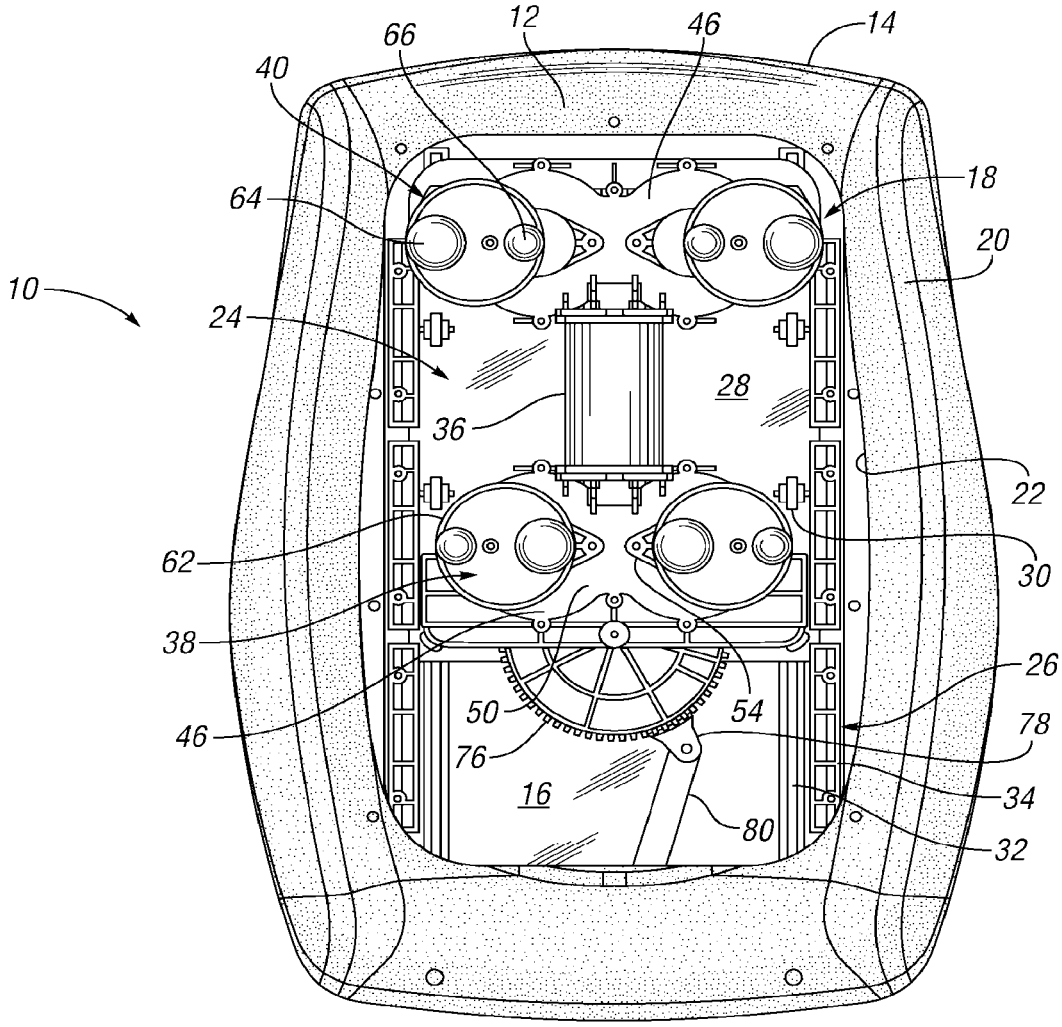
FIG. 1 is a front side elevation view of a body massage apparatus in accordance with the present invention.
Figure 2:
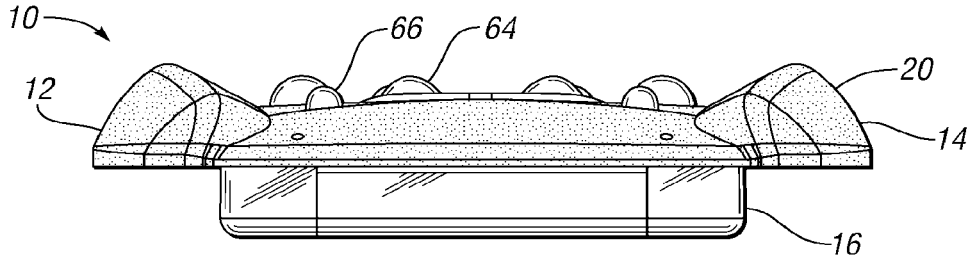
FIG. 2 is a bottom plan view of the body massage apparatus of FIG. 1.

With reference to FIGS. 1 and 2, an exemplary embodiment body massage apparatus is illustrated in accordance with the present invention and is referenced generally by numeral 10. The body massage apparatus 10 is illustrated as a body massager including a backrest region 12. A seat support region may also be provided, although not illustrated with the embodiment of the body massage apparatus 10 of FIGS. 1 and 2. Internal assemblies of the backrest region 12 are collectively retained within a flexible cover (not shown), which may be formed of a flexible yet resilient material such as leather or high quality vinyl.

Various massage effects may be provided by the massage apparatus 10. Such massage effects may include a rubbing massage effect, a rolling massage effect, and/or a kneading massage effect provided in the backrest region 12. For the embodiment illustrated, the massage apparatus 10 is operable to provide a kneading massage effect longitudinally along the length of the backrest region 12.

The backrest region 12 is sized to be received upon a backrest of a conventional chair. Additionally, the massage apparatus 10 is portable due to its compact size and light weight so that the user may place the massage apparatus 10 upon a conventional chair for receiving a massage when seated upon the chair. Of course, the user may employ the massage apparatus 10 with or without utilization of a conventional chair. Alternatively, the user may lay the massage apparatus 10 flat upon an underlying support surface for experiencing a massage effect in a lie down position.

The backrest region 12 may include an overall height and width that correspond to a conventional chair and the backrest region 12 may have a thickness that is adequate for housing the massage assembly therein, while avoiding disruption of comfort and support provided by the underlying chair. The backrest region 12 may also include a pair of straps for securing the massage apparatus 10 to the conventional chair.

The backrest region 12 may include a two-piece housing provided by a forward housing portion 14 and a rearward housing portion 16. The forward housing portion 14 and the rearward housing portion 16 are sized and adaptable to be secured together by a plurality of fasteners for retaining components of a massage assembly 18 therein. The forward housing portion 14 is sized and contoured to receive a body part of a user, such as a back rested thereupon. The forward housing portion 14 may include a cushion for enhancing comfort of the user. Additionally, the forward housing portion 14 may include a pair of laterally spaced bolsters 20, which may be cushioned, with an aperture 22 disposed therebetween. The aperture 22 permits a massage formation of the massage assembly 18 to extend therethrough for contact with a body part of the user. The massage formation of the massage assembly 18 is illustrated extending through the aperture 22 in FIG. 2.

Figure 3:
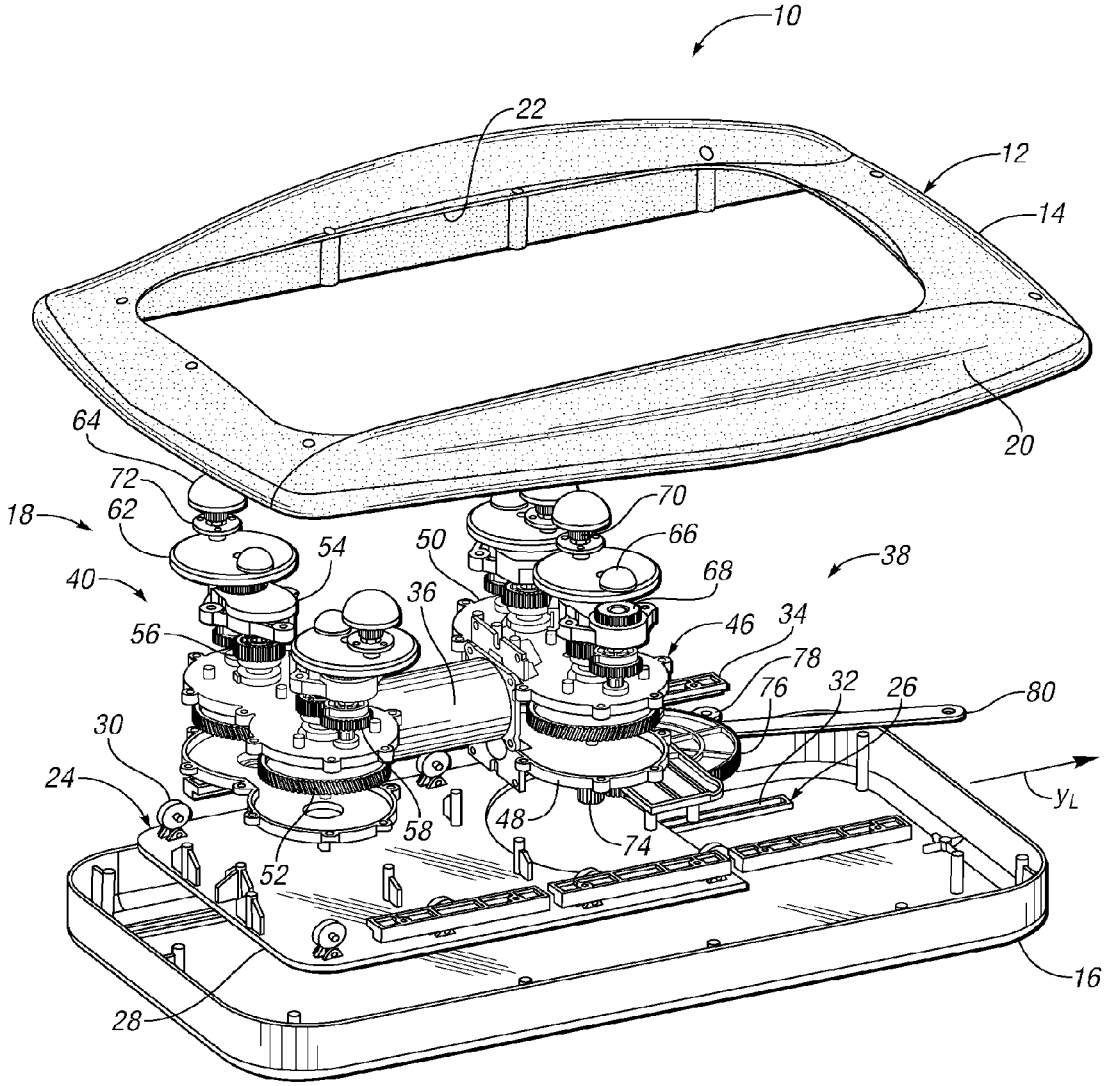
FIG. 3 is a partially exploded perspective view of the body massage apparatus of FIG. 1.
Figure 4:
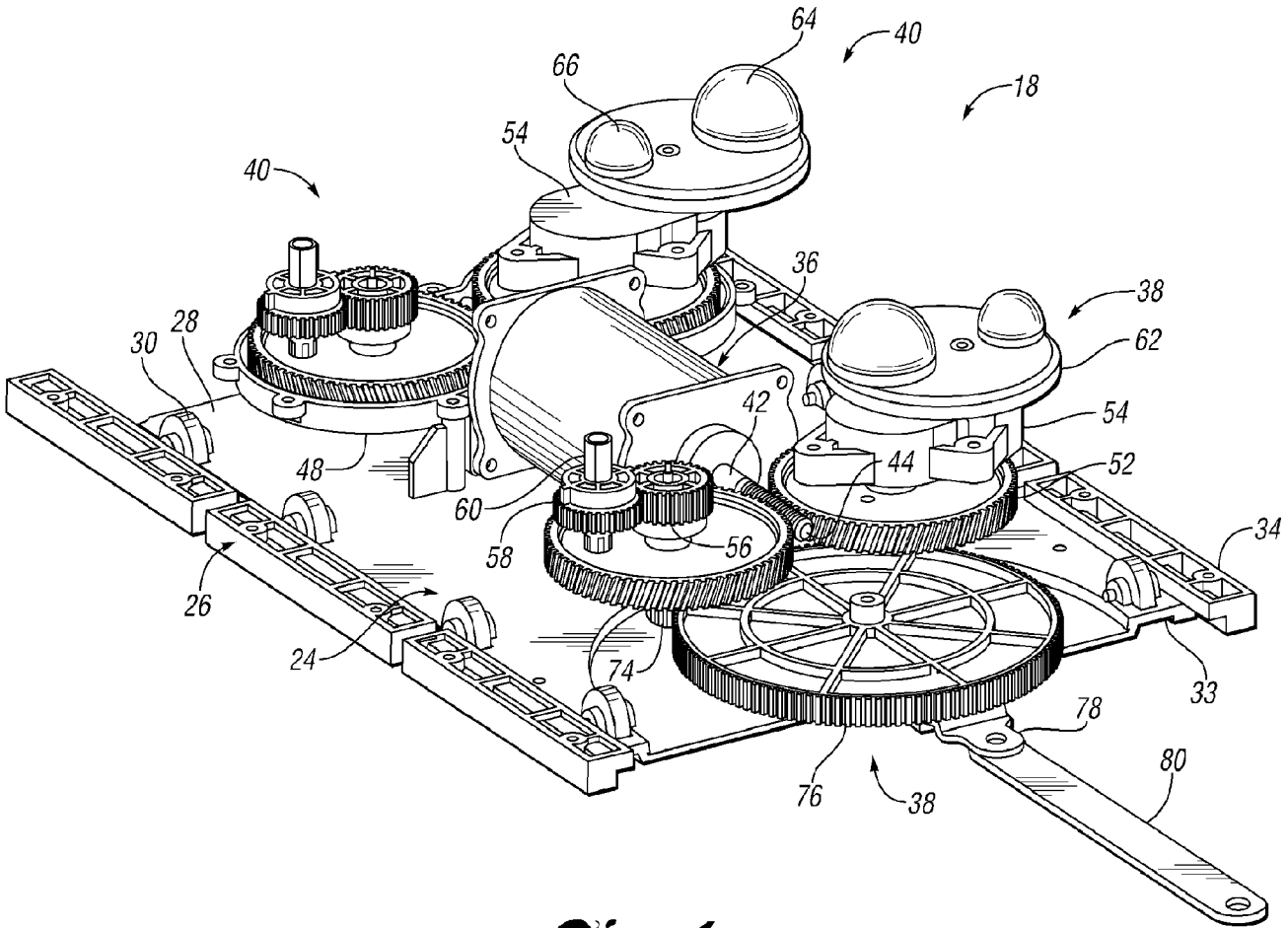
FIG. 4 is a partially disassembled view of a massage assembly of the body massage apparatus of FIG. 1.

Referring now to FIG. 3, the body massage apparatus 10 is illustrated partially exploded for further detail of the massage assembly 18. The massage assembly 18 is also illustrated in FIG. 4, removed from the backrest region 12.

The massage assembly 18 of the present embodiment includes a carriage 24 which cooperates with the rearward housing portion 16 for limited longitudinal translation within the backrest region 12. Accordingly, the rearward housing portion 16 may include a longitudinal guide 26 mounted within the rearward housing portion 16 for cooperating with the carriage 24. The longitudinal direction y corresponds with the direction of travel of the carriage 24, and the housing 14, 16 includes a longitudinal axis $y_L$, which is illustrated in FIG. 3.

The carriage 24 may include a carriage plate 28 for translation along the guide 26. The carriage plate 28 may be provided with a series of rollers 30 mounted to lateral sides of the carriage plate 28 for rolling engagement along the guide 26. The guide 26 of the present embodiment includes a pair of longitudinal channels 32 formed within the rearward housing portion 16, which receive the rollers 30 for maintaining a transverse orientation of the carriage 24 relative to the guide 26. The channels 32 may include side walls that extend upward from the rearward housing portion 16; and the carriage plate 28 may include a pair of keyways 33 formed in the underside of the carriage plate 28 for engagement with the sidewalls of the channels 32. Channels may also be provided in a back surface of the forward housing portion 14 for engaging the rollers 30. The rollers 30 provide bearing support to the carriage 24 as it translates along the guide 26.

The guide 26 may also be provided with a pair of gibs 34, which may be fastened to the rearward housing portion 16 for retaining the carriage plate 28 relative to the rearward housing portion 16 during translation of the carriage 24.

The massage apparatus 10 includes a motor 36 for driving the carriage 24 along the guide 26. The motor 36 may be an electric motor, such as a direct current motor, or the motor may be any suitable motor within the spirit and scope of the present invention. In the embodiment illustrated in FIGS. 3 and 4, the motor 36 may be mounted upon the carriage 24 and fastened to the carriage plate 28 for driving a massage feature of the massage assembly 18. Of course, the invention contemplates that the motor 36 may be mounted to the rearward housing portion 16.

In one embodiment of the invention, the motor 36 drives the carriage 24 along the guide 26 and imparts a kneading massage effect from the massage assembly 18.

The massage assembly 18 is illustrated having a pair of rotary kneading massage mechanisms 38, 40 mounted upon the carriage 24. Of course, the invention contemplates any number or style of massage mechanisms mounted upon the carriage plate 24.

In one embodiment of the invention, the motor 36 includes a rotary output shaft 42 (FIG. 4) having a pair of distal ends extending from the motor 36. Each distal end of the output shaft 42 includes a worm drive 44 mounted to or formed into the output shaft 42.

The distal ends of the output shaft 42 each extend into a gearbox 46 mounted to the carriage plate 28. Each gearbox 46 includes a lower housing portion 48 and an upper housing portion 50. A pair of worm gears 52 are mounted within each gearbox 46 in geared engagement with the worm drive 44 of the associated distal end of the output shaft 42. The worm gears 52 provide a reduced rotation from that imparted to the motor output shaft 42 by the motor 36.

A pair of secondary gearboxes 54 may be provided upon each gearbox 46. For example, each secondary gearbox 54 may be fastened to the upper housing portion 50 of the associated gearbox 46. A first spur gear 56 may be provided within each secondary gearbox 54 and driven by a corresponding worm gear 52 for rotation with the worm gear 52. For example, each first spur gear 56 may share a common shaft and axis of rotation with that of the associated worm gear 52. A second spur gear 58 may be supported for rotation within each secondary gear box 54 and engaged with the corresponding first spur gear 56 for being driven thereby. Each second spur gear 58 is mounted upon a shaft 60 which extends out of the corresponding secondary gear box 54. A massage bracket 62 may be mounted to each shaft 60 and driven by the second spur gear 58 for rotation relative to the carriage 24. A massage formation may be provided on each massage bracket 62.

In summary, the motor 36 of the embodiment of FIGS. 3 and 4 drives the four worm gears 52, which each provide a reduced rotation to a first spur gear 56. Each first spur gear 56 drives a second spur gear 58, which drives a massage bracket 62. Accordingly, a rotary kneading massage is provided with asynchronously rotating massage brackets 62, which are laterally spaced apart and longitudinally spaced apart from another pair of rotating massage brackets 62 for providing symmetrical rotary kneading massage effects to a body part of a user at two longitudinal locations upon the user's body part. For example, if a user rests his or her back against the forward housing portion 14 of the backrest region 12, the user would receive a rotary kneading massage effect, which is spaced about a center of the user's back at two regions spaced lengthwise along the user's back.

Each massage bracket may include a pair of hemispherical massage nodes 64, 66 mounted to the massage bracket 62 or formed integrally with the massage bracket 62. The massage nodes 64, 66 may vary in diameter for varying the rotary kneading massage effect applied to the user. Additionally, the massage nodes 64, 66 may be rotationally mounted to the massage bracket 62 to provide a rolling massage effect concomitantly with the rotary kneading massage effect by the rotation of the massage bracket 62.

Additionally, one or more of the massage nodes 64, 66 may be rotationally driven relative to the corresponding massage bracket 62. For example, each gearbox 46 may include a pair of third spur gears 68 fixed relative thereto with the second spur gear shaft 60 extending through the fixed third spur gear 68. One of the massage nodes, such as the larger massage node 64 may include a splined shaft 70 extending through the corresponding massage bracket 62, thereby defining a fourth spur gear, which is in engagement with the third spur gear 68. As the massage bracket 62 is rotated relative to the carriage 24 and consequently rotated relative to the fixed third spur gear 68, the large massage nodes 64 are each driven for rotation relative to the corresponding massage bracket 62 about an axis of the massage node 64 that is offset from the shaft 60 about which the massage bracket 62 rotates.

Accordingly, an enhanced rotary massage effect may be provided by each massage bracket 62 with the large massage node revolving about the shaft 60 with the massage bracket 62 and rotating about the shaft 70 relative to the massage bracket 62. In order to reduce friction between each large massage node 64 and the corresponding massage bracket 62, a thrust bearing assembly 72 may be provided between the rotating massage node 64 and the massage bracket 62.

In one embodiment of the invention, the motor 36 drives the carriage 24 along the guide 26. For the embodiment illustrated in FIGS. 3 and 4, continuous rotation of the motor output shaft 42 results in reciprocating translation of the carriage 24 along the guide 26. Therefore, the rotation of the motor 36 does not need to be reversed as the carriage 24 reaches a limit in longitudinal travel, and complexities that are commonly associated with massage carriages may be eliminated or minimized.

Referring now to FIG. 4, one of the worm gears 52 drives a spur gear 74 mounted to an underside thereof for rotation about a common axis with the worm gear 52. A large reduction spur gear 76 is provided mounted beneath one of the gearboxes 46 in geared engagement with the spur gear 74 and driven thereby. The reduction gear 76 is mounted coaxially with a first link 78 for driving the link 78 relative to the carriage 24. A second link 80 is pivotally connected to the first link 78 at one end and pivotally connected to rearward housing portion 16 at the other end for oscillating relative to the rearward housing portion 16 as the first link 78 is rotated.

The carriage 24, guide 26 and links 78, 80 collectively provide a slider crank mechanism for imparting continuous rotation of the motor 36 to linear reciprocating motion of the carriage 24 along the guide 26. Although a linkage, such as a slider crank mechanism is illustrated, the invention contemplates any mechanism for converting continuous rotary motion to reciprocating motion for translating the carriage 24 along the guide 26.

Figure 5:
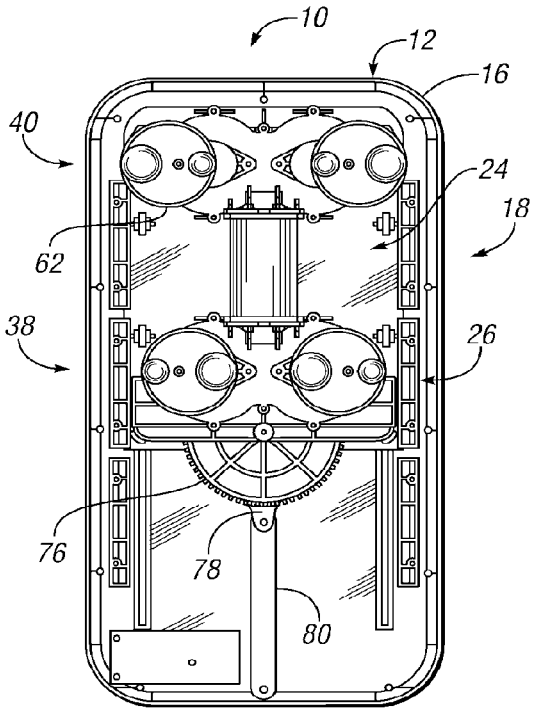
FIG. 5 is a front side elevation view of the body massage apparatus of FIG. 1, illustrated partially disassembled in a first position of the massage assembly.
Figure 6:
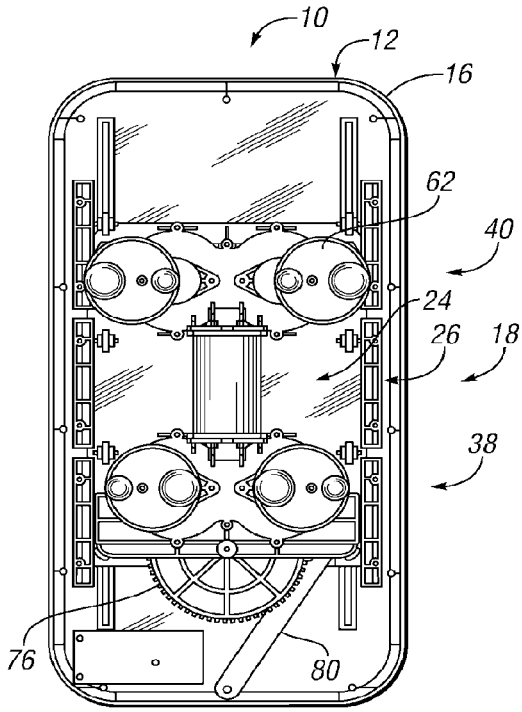
FIG. 6 is another front side elevation view of the partially disassembled body massage apparatus of FIG. 5, illustrated in another position of the massage assembly.
Figure 7:
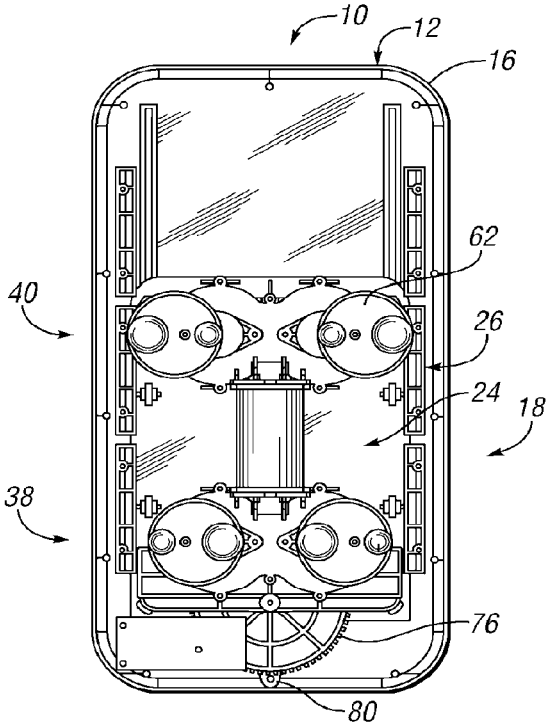
FIG. 7 is yet another partially disassembled front side elevation view of the body massage apparatus of FIG. 5, illustrated in yet another position of the massage assembly.
Figure 8:
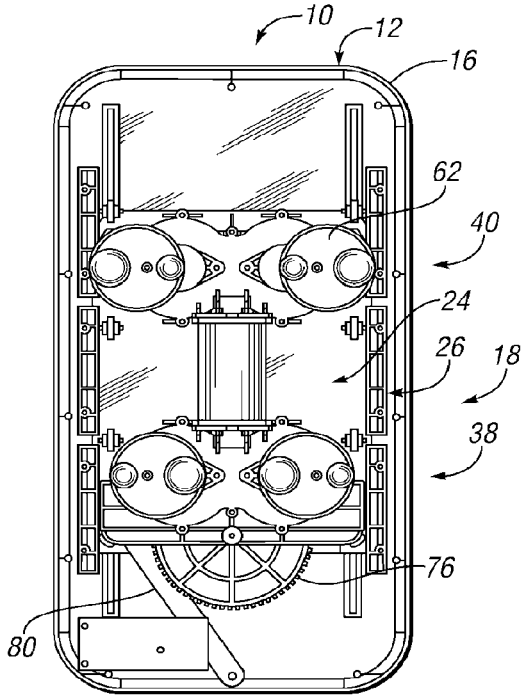
FIG. 8 is another partially disassembled front side elevation view of the body massage apparatus of FIG. 5, illustrated in another position of the massage assembly.

Referring now to FIGS. 5-8, the massage apparatus 10 is illustrated with the carriage 24 translating along the guide 26. In FIG. 5, the first link 78 is illustrated oriented at a six o'clock orientation such that the second link 80 is oriented longitudinally, thereby extending the carriage 24 to an uppermost orientation along the guide 26. As the reduction gear 76 rotates counterclockwise, the first link 78 is extended to a three o'clock orientation as illustrated in FIG. 6, thereby oscillating the second link 80 laterally and pulling the carriage 24 to an intermediate position along the guide 26. In FIG. 7, the reduction gear 76 has driven the first link 78 to a twelve o'clock position such that the second link 80 is once again oriented longitudinally and the carriage 24 is oriented at a lowermost orientation along the guide 26. Referring now to FIG. 8, the reduction gear 76 is illustrated having driven the first link 78 to a nine o'clock position such that the second link 80 is translated laterally outboard with the carriage 24 at an intermediate position along the guide 26. As the motor 36 continues to rotate, the carriage is once again translated from the intermediate position of FIG. 8 to the uppermost position of FIG. 5.

The invention contemplates that various speeds and durations may be provided by the motor 36 for varying an output massage effect of the body massage apparatus 10.

The body massage apparatus 10 of the present invention provides a rotary kneading massage effect upon a body part of a user, that translates along a length of the massage apparatus 10, without requiring changes in direction of the rotation of the motor 36 or multiple switches or sensors at an associated controls architecture for effectuating such motor operations. By providing a pair of rotary massage mechanisms 38, 40, a duplicated massage effect may be provided to the user by the massage apparatus 10.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A body massager comprising:

a housing having a longitudinal axis and an external contact surface for receiving a portion of a body of a user;

a longitudinal guide mounted in the housing;

a carriage oriented in the housing and cooperating with the guide for longitudinal translation in the housing along the guide;

a motor oriented in the housing, operably coupled to the housing and the carriage such that continuous rotation of the motor in one rotary direction translates the carriage along the guide in at least two opposed directions; and a massage formation supported by the carriage for imparting a massage effect upon the portion of the user's body as the carriage is translated relative to the housing.

2. The body massager of claim 1 further comprising a linkage operably connected to the housing, the carriage and the motor for receiving rotary motion from the motor and for imparting a reciprocating motion to the carriage.

3. The body massager of claim 2 wherein the linkage further comprises a slider-crank mechanism.

4. The body massager of claim 1 wherein the motor is mounted to the carriage.

5. The body massager of claim 4 further comprising:

a first link rotationally mounted to the carriage and driven by the motor; and a second link having a first end pivotally connected to the first link, and a second end pivotally connected to the housing;

wherein the motor rotates the first link for rotation relative to the carriage thereby oscillating the second link relative to the housing and driving the carriage for reciprocation relative to the housing.

6. The body massager of claim 4 further comprising:

a motor output shaft rotationally driven by the motor;

a massage bracket rotationally mounted to the carriage and operably engaged to the motor output shaft for rotation about a first axis of rotation as the motor output shaft is driven; and a massage node rotationally mounted to the massage bracket about a second axis of rotation offset from the first axis of rotation for revolving about the first axis of rotation as the massage bracket is driven by the motor, the massage node being operably engaged to the motor output shaft for rotation relative to the massage bracket about the second axis of rotation as the massage node is driven by the motor.

7. The body massager of claim 4 further comprising:

a motor output shaft rotationally driven by the motor:

a first kneading massage mechanism mounted to the carriage and operably coupled to the motor output shaft for imparting a first kneading massage effect to the user; and a second kneading massage mechanism mounted to the carriage spaced apart from the first kneading massage mechanism, the second kneading massage mechanism being operably coupled to the motor output shaft for imparting a second kneading massage effect to the user.

8. The body massager of claim 7 wherein at least one of the first and second kneading massage mechanisms further comprises a rotary kneading massage mechanism.

9. The body massager of claim 4 further comprising:

a motor output shaft rotationally driven by the motor;

a worm drive mounted to the motor output shaft;

a pair of worm gears rotationally mounted to the carriage in laterally spaced opposition, the pair of worm gears being driven by the worm drive; and a pair of massage nodes operably coupled to each worm gear for imparting a rotary massage effect to the user.

10. The body massager of claim 9 further comprising:

a first spur gear mounted for rotation with one of the pair of worm gears;

a second spur gear rotationally mounted to the carriage and driven by the first spur gear; and a link pivotally connected to the second spur gear and pivotally connected to the housing;

wherein the motor drives the pair of worm gears and the first spur gear, which consequently drives the second spur gear thereby oscillating the link relative to the housing and driving the carriage for reciprocation relative to the housing.

11. The body massager of claim 9 further comprising:

a first spur gear mounted for rotation with one of the pair of worm gears;

a second spur gear rotationally mounted to the carriage and driven by the first spur gear;

a massage bracket mounted for rotation with the second spur gear;

a first massage node mounted to the massage bracket; and a second massage node rotationally mounted to the massage bracket.

12. The body massager of claim 11 further comprising:

a third spur gear fixed to the carriage; and a fourth spur gear rotationally mounted to second massage node and engaged with the third spur gear such that rotation of the massage bracket relative to the carriage imparts rotation to the second massage node relative to the massage bracket.

13. The body massager of claim 4 further comprising:

a motor output shaft having a pair of opposed distal ends extending from the motor and rotationally driven thereby;

a pair of worm drives each mounted to one of the distal ends of the motor output shaft;

a first pair of worm gears rotationally mounted to the carriage in laterally spaced opposition, the first pair of worm gears being driven by one of the pair of worm drives;

a second pair of worm gears rotationally mounted to the carriage in laterally spaced opposition, the second pair of worm gears being driven by the other of the pair of worm drives; and a pair of massage nodes operably coupled to each worm gear for imparting a rotary massage effect to the user.

14. The body massager of claim 13 further comprising:

a first spur gear mounted for rotation with one of the worm gears;

a second spur gear rotationally mounted to the carriage and driven by the first spur gear; and a link pivotally connected to the second spur gear and pivotally connected to the housing;

wherein the motor drives the pair of worm gears and the first spur gear, which consequently drives the second spur gear thereby oscillating the link relative to the housing and driving the carriage for reciprocation relative to the housing.

15. The body massager of claim 13 further comprising:

a plurality of first spur gears each mounted for rotation with one of the worm gears;

a plurality of second spur gears each rotationally mounted to the carriage and driven by one of the plurality of first spur gears;

a plurality of massage brackets each mounted for rotation with one of the plurality of second spur gears;

a first plurality of massage nodes each mounted to one of the plurality of massage brackets; and a second plurality of massage nodes each rotationally mounted to one of the massage brackets.

16. The body massager of claim 15 further comprising:

a third plurality of spur gears each mounted for rotation with one of the second plurality of spur gears; and a fourth plurality of spur gears each rotationally mounted to one of the second plurality of massage nodes and driven by one of the third plurality of spur gears for rotating the second massage nodes relative to the associated massage bracket.

17. A body massager comprising:

a housing having an external contact surface for receiving a portion of a body of a user;

a motor oriented in the housing, the motor having an output shaft driven thereby;

a massage bracket rotationally mounted to the housing and operably engaged to the motor output shaft for rotation about a first axis of rotation as the motor output shaft is driven; and a massage node rotationally mounted to the massage bracket about a second axis of rotation offset from the first axis of rotation for revolving about the first axis of rotation as the massage bracket is driven by the motor, the massage node being operably engaged to the motor output shaft for rotation relative to the massage bracket about the second axis of rotation as the massage node is driven by the motor.

18. The body massager of claim 17 further comprising:

a longitudinal guide mounted in the housing; and a carriage oriented in the housing and cooperating with the guide for longitudinal translation in the housing along the guide;

wherein the massage bracket is mounted to the carriage; and wherein the motor is operably coupled to the housing and the carriage for translating the carriage along the guide.

19. A body massager comprising:

a housing having a longitudinal axis and an external contact surface for receiving a portion of a body of a user;

a longitudinal guide mounted in the housing;

a carriage oriented in the housing and cooperating with the guide for longitudinal translation in the housing along the guide;

a motor mounted to the carriage, the motor having a rotary output shaft driven thereby, the motor output shaft being operably coupled to the housing to translate the carriage along the guide;

a first kneading massage mechanism mounted to the carriage and operably coupled to the motor output shaft for imparting a first kneading massage effect to the user; and a second kneading massage mechanism mounted to the carriage spaced longitudinally apart from the first kneading massage mechanism, the second kneading massage mechanism being operably coupled to the motor output shaft for imparting a second kneading massage effect to the user.

20. The body massager of claim 19 wherein continuous rotation of the motor in one rotary direction translates the carriage along the guide in at least two opposed directions.

21. The body massager of claim 5 wherein the second link is pivotally connected to the first link at a location upon the first end of the second link; and wherein the second link is pivotally connected to the housing at a location upon the housing, and at a location upon the second end of the second link that is spaced apart from the first end.

22. The body massager of claim 17 further comprising:

a spur gear affixed to the housing about the first axis of rotation; and a splined shaft extending from the massage node about the second axis of rotation in engagement with the spur gear such that as rotation of the massage bracket revolves the massage node about the first axis of rotation, the splined shaft rotates due to engagement with the spur gear thereby rotating the massage node about the second axis of rotation.

* * * * *

UNITED STATES PATENT AND TRADEMARK OFFICE

CERTIFICATE OF CORRECTION

PATENT NO. : 7,597,669 B2
APPLICATION NO. : 11/365238
DATED : October 6, 2009
INVENTOR(S) : Chien Ming Huang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 872 days.

Signed and Sealed this

Twenty-eighth Day of September, 2010

David J. Kappos

David J. Kappos
*Director of the United States Patent and Trademark Office*